US011107643B2

(12) United States Patent
Schmidt et al.

(10) Patent No.: US 11,107,643 B2
(45) Date of Patent: Aug. 31, 2021

(54) CONTACT PRESS-ON ASSEMBLY

(71) Applicant: SIEMENS AKTIENGESELLSCHAFT, Munich (DE)

(72) Inventors: Anne Schmidt, Berlin (DE); Ai Guang Zhao, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 16/630,562

(22) PCT Filed: Jun. 14, 2018

(86) PCT No.: PCT/EP2018/065758

§ 371 (c)(1),
(2) Date: Jan. 13, 2020

(87) PCT Pub. No.: WO2019/011571

PCT Pub. Date: Jan. 17, 2019

(65) Prior Publication Data

US 2020/0388445 A1 Dec. 10, 2020

(30) Foreign Application Priority Data

Jul. 14, 2017 (DE) ..... 102017212066

(51) Int. Cl.
*H01H 1/50* (2006.01)
*H01H 3/48* (2006.01)
(Continued)

(52) U.S. Cl.
CPC ..... *H01H 1/502* (2013.01); *H01H 3/48* (2013.01); *H01H 33/42* (2013.01);
(Continued)

(58) Field of Classification Search
CPC ..... H01H 1/502; H01H 3/48; H01H 33/42; H01H 33/666; H01H 2033/426; H01H 2033/6667; H01H 2235/01; H01H 33/66
(Continued)

(56) References Cited

U.S. PATENT DOCUMENTS 6,927,356 B2 * 8/2005 Sato ..... H01H 33/666 218/154
7,215,228 B2 * 5/2007 Rhein ..... H01H 33/6662 335/6
(Continued)

FOREIGN PATENT DOCUMENTS

CN 2386525 Y 7/2000
CN 104576169 A 4/2015
(Continued)

OTHER PUBLICATIONS

PCT International Search Report and Written Opinion of International Searching Authority dated Sep. 26, 2018 corresponding to PCT International Application No. PCT/EP2018/065758 filed Jun. 14, 2018.

*Primary Examiner* — William A Bolton
(74) *Attorney, Agent, or Firm* — Laurence A. Greenberg; Werner H. Stemer; Ralph E. Locher

(57) ABSTRACT

A contact press-on assembly for a switching contact piece of an electrical switching unit has a first stop and a second stop. A spring element extends between the two stops, wherein the first stop can move relative to the second stop. The second stop provides a counterbearing for the first stop, wherein a rotary bearing for the spring element can move together with the first stop.

11 Claims, 3 Drawing Sheets

(51) Int. Cl.
*H01H 33/42* (2006.01)
*H01H 33/666* (2006.01)

(52) U.S. Cl.
CPC ... *H01H 33/666* (2013.01); *H01H 2033/6667* (2013.01); *H01H 2235/01* (2013.01)

(58) Field of Classification Search
USPC ..... 218/118, 120, 123, 140, 146; 200/400, 200/430, 453
See application file for complete search history.

(56) References Cited

U.S. PATENT DOCUMENTS

| | | | | |
|---|---|---|---|---|
| 7,829,814 | B2 * | 11/2010 | Marchand | H01H 33/6606 218/140 |
| 8,309,872 | B2 | 11/2012 | Peter et al. | |
| 9,659,729 | B2 | 5/2017 | Bartz et al. | |
| 2010/0078302 | A1 * | 4/2010 | Erk | H01H 33/666 200/400 |
| 2013/0264312 | A1 * | 10/2013 | Gentsch | B29C 45/16 218/140 |
| 2016/0300678 | A1 * | 10/2016 | Kakio | H01H 3/60 |

FOREIGN PATENT DOCUMENTS

| | | | |
|---|---|---|---|
| DE | 102013221910 | A1 | 4/2015 |
| EP | 3 089 188 | A1 | 11/2016 |

* cited by examiner

CONTACT PRESS-ON ASSEMBLY

BACKGROUND OF THE INVENTION

Field of the Invention

The invention relates to a contact press-on assembly for a switching contact piece of an electrical switching unit having a first stop and a second stop, between which a spring element extends, the first stop being movable relative to the second stop, the second stop forming an abutment for the first stop and at least one of the stops providing a rotary bearing for the spring element.

Such a contact press-on assembly is known for example from the utility model CN 2386525 Y. The contact press-on assembly there is provided for a switching contact piece of an electrical switching unit. A spring element extends between a first stop and a second stop. The first stop is movable relative to the second stop, the second stop forming an abutment for the first stop. It is also envisaged to provide a stop that has a rotary bearing.

The known contact press-on assembly uses a complex axial ball bearing as the rotary bearing. On the one hand, easy rotation of elements of the contact press-on assembly in relation to one another is made possible by the known construction. On the other hand, however, this easy action is brought about by increased masses and an increased installation space as compared with conventional contact press-on assemblies.

SUMMARY OF THE INVENTION

An object of the invention is consequently to provide a contact press-on assembly that makes sufficient rotational mobility possible at a contact press-on assembly along with a reduction in the mass and sufficient mechanical stability in a compact installation space.

According to the invention, the object is achieved in the case of a contact press-on assembly of the type stated at the beginning by the rotary bearing being movable together with the first stop.

An electrical switching unit has a switching contact piece, which is movable relative to a further switching contact piece. A relative movement of the switching contact pieces in relation to one another makes it possible for a current path to be established or broken. In order to make sufficient contacting of the switching contact pieces possible, a contact press-on assembly that secures the switching contact pieces in a relative position in relation to one another is used. The relative position to be secured may be a switched-on state of the electrical switching unit. In the switched-on state, the switching contact pieces touch one another and a current path is closed by way of the switching contact pieces. The contact press-on assembly brings about the effect that a force acts on the switching contact pieces that are movable relatively in relation to one another, so that the position of the switching contact pieces in relation to one another is secured. The contact press-on assembly may preferably brace the switching contact pieces against one another and move them toward one another or press them against one another. For this purpose, the contact press-on assembly is for example part of a kinematic chain, which makes possible the transmission of a movement for producing a relative movement of the switching contact pieces of the switching unit in relation to one another. A spring element of the contact press-on assembly is arranged between a first stop and a second stop, the stops being movable relatively in relation to one another. A relative movement of the stops allows the spring element to be tensioned or subjected to a force, so that the energy thereby introduced into the spring element is available to bring about a pressing of the contacts of the switching contact pieces of the switching unit, for example in the inactive state of the kinematic chain. A tensioning of the spring element takes place for example by the stops being brought together or moved apart from one another. Using the second stop to form an abutment for the first stop provides a reference, in order to make it possible for the spring element to be tensioned or relaxed even when all of the stops are movable. This makes it possible to use the contact press-on assembly itself as a moving part (transmission element) of the kinematic chain. For example, the contact press-on assembly may serve for a transmission of a movement, for example a linear movement. In this case, on account of the effectiveness of the spring element between the stops, the contact press-on assembly can act as a so-called dead-time element, which, for example on account of an elastic deformability of the spring element, brings about a delayed transfer of a movement within the kinematic chain. Depending on the design of the spring element, the spring element may however also have such a stiffness that it is only when an overtravel occurs, i.e. after the switching contact pieces of the switching unit make contact with one another, that a further movement within the kinematic chain is no longer transmitted to the switching contact pieces. Thus, the kinematic chain continues to be protected from being damaged. In this case, the contact press-on assembly may be advantageously formed in such a way that the spring element is only acted on from one side. That is to say that, in particular in the case of a translational transmission of a movement by means of the contact press-on assembly, the spring element can effectively function when there is a movement with a first directional sense, while a direct transmission (rigid coupling) of the movement can take place by means of the contact press-on assembly when there is a movement with a second directional sense opposite to the first directional sense.

On account of external force effects (for example during a movement, assembly, etc.), rotational forces may occur within the kinematic chain. This is disadvantageous, since for example connecting elements, such as bolts, splints, etc., may be sheared off or bent as a result. For example, screw connections may also be loosened over time as a result of such rotational loads. The use of a rotary bearing allows the stress of such forces to be relieved in the contact press-on assembly. The rotary bearing can thus serve as a freewheeling mechanism, in order for example to protect the spring element from transverse forces introduced from outside. As a result, the spring action of the spring element can be maintained. In addition, further forces can also be absorbed in the contact press-on assembly, so that not only the spring element but also for example further elements, such as screwed connections, bolts, splinted connections of the kinematic chain, are protected.

Providing a stop with the rotary bearing makes it possible to be able to perform freewheeling or relieving the stress of forces directly in the area of the spring element. By moving the stop together with the rotary bearing, a decoupling of rotational movements at the spring element can be performed independently of the state of loading of the spring element. By moving the first stop together with the rotary bearing, it is thereby possible to dispense with the use of a number of rotary bearings. Consequently, the installation space of a contact press-on assembly according to the invention is reduced. Furthermore, by dispensing with a further rotary bearing, the mass of the contact press-on assembly, and consequently the moved mass in the kinematic chain, is reduced. The movement of the rotary bearing together with the first stop allows a rotational movement to be intercepted directly at the spring element or eliminated in the rotary bearing. The spring element is consequently protected from outside forces. Advantageously, the rotary bearing may be integrated in the first stop, so that no additional installation space is required at the first stop for receiving the rotary bearing. The rotary bearing can thus move, in particular relative to the second stop, while the first stop may have the rotary bearing. Furthermore, the spring element may serve for securing the rotary bearing.

Advantageously, it may also be provided that the first stop is guided by the second stop.

The second stop may serve for guiding the first stop. As a result, there is the possibility of using the second stop as a reference basis for a relative movement of the first stop and also for a relative movement of the rotary bearing. For example, the second stop may be formed in the manner of a housing, for example as a hollow-cylindrical housing, which in particular encloses the spring element. This allows the second stop to act as a spring housing. The first stop may be supported on the second stop or on the housing and be guided by the second stop. As a result, a defined linear relative movement between the first stop and the second stop is made possible. Canting and tilting are avoided. For example, the first stop may enter the second stop. Advantageously, it may in this case be provided that the second stop is designed in the manner of a cylinder and the first stop is designed in the manner of a piston, so that the first stop can enter the second stop. A relative movement of the first stop and the second stop allows the spring element to be tensioned or relaxed.

It may in this case be provided that the stops are movable axially in relation to one another.

An axial mobility of the stops makes a linear movement possible in an easy way, in order to bring about tensioning or relaxing of a spring element. Advantageously, the path of movement of the relative movement of the first stop and the second stop may be aligned coaxially, in particular congruently, with respect to a movement that the contact press-on assembly performs within an integration in a kinematic chain. As a result, it is possible in an easy way on the one hand to use the contact press-on assembly for transmitting a movement and on the other hand to use the contact press-on assembly for pressing a switching contact piece against a mating contact of an electrical switching unit. At least one of the stops may be formed and aligned coaxially with respect to the axis of movement.

Advantageously, it may also be provided that the first stop has a rotationally movable disk, which is supported on the second stop.

A rotationally movable disk offers the possibility of providing a relative movement of the rotationally movable disk with respect to further subassemblies of the first stop, for example with respect to a carrying element. A rotationally movable disk may in this case be formed for example as a full circular disk. It may however also be provided that only an annular form is used in order to form the rotationally movable disk. In addition, the disk may also be only formed in portions, so that for example only sectors of a circular disk are used. Advantageously, the rotationally movable disk may be supported on the second stop by portions of its body over the lateral surface. Advantageously, a sliding arrangement may be provided there, in order to reduce the frictional resistance between the rotationally movable disk and the second stop. This may take place for example by bush-like applications of material on the rotationally movable disk. For example, polytetrafluoroethylene strips or copper bushes may serve as sliding elements. On the end face, introduction of a force of the spring element may take place on the disk, so that the axis of movement of the first stop relative to the second stop and also the introduction of a force of the spring element are aligned substantially parallel to one another. Preferably, the spring element may act on the rotationally movable disk, or be set against the rotationally movable disk, indirectly or directly at the end face.

A further advantageous refinement may provide that the rotationally movable disk is connected to a carrying element of the first stop by way of a clearance fit.

A carrying element of the first stop serves for positioning the rotationally movable disk. The rotationally movable disk may be placed on the carrying element or set against the carrying element, so that a rotational movement of the rotationally movable disk relative to the carrying element is made possible. In this case, for making a rotational movement possible, the carrying element and the rotationally movable disk may be connected to one another by way of a clearance fit. The clearance fit may in this case be secured by the force effect of the spring element, so that removal or loosening of the rotationally movable disk and the carrying element is prevented by the spring element. The spring element serves as a means of securing the clearance fit. The clearance fit may bring about axial and radial guidance of the rotationally movable disk.

A further advantageous refinement may provide that the first stop has a guide pin, which is at least partially enclosed by the spring element.

The use of a guide pin at the first stop allows deflecting or directing of the spring element to be made possible beyond the function of the stop. The spring element may for example at least partially enclose the guide pin, so that the spring element is secured on the guide pin, and consequently on the first stop. As a result, loosening or canting of the spring element is made more difficult. Furthermore, the guide pin allows the spring element to lie in place on the rotationally movable disk in a secured manner.

The guide pin may for example be formed at least from parts of the rotationally movable disk. In particular when using a rotationally movable disk that has an annular form, the central region of the disk may be used to form the guide pin. The guide pin may thus be formed for example from parts of the rotationally movable disk. The guide pin may however also be formed at least partially from the carrying element.

Advantageously, it may also be provided that the guide pin is guided by the second stop.

The guide pin advantageously deflects and directs the spring element. By guiding the guide pin on the second stop, the position of the guide pin is secured. As a result, the relative movement of the first stop and the second stop in relation to one another is also stabilized by way of the guide pin. Furthermore, improved mounting or guiding of the spring element can be performed, so that undesired bending or buckling of the spring element is made more difficult. Depending on the construction of the guide pin, guiding of the first stop on the second stop may be performed by the carrying element and/or by the rotationally movable disk and/or at the guide pin.

A further advantageous refinement may provide that the first stop and the second stop are guided in a telescoping manner.

The first stop and the second stop are movable relatively in relation to one another. This movement may preferably be a linear relative movement. The spring element extends between the stops. The use of telescopic stops allows the relative movement of the first stop and the second stop to be transmitted in an improved form. Telescoping, i.e. the first stop and the second stop entering one another, has the additional effect of preventing canting of the stops in relation to one another. In order additionally to improve the guidance, it may be provided that the first stop and the second stop are guided in a telescoping manner relatively in relation to one another at a number of points. For example, the second stop may surround the first stop in the manner of a housing, while the spring element is arranged inside the second stop. The spring element in turn may be covered, and ultimately guided, on its inner and outer lateral surfaces by the first stop or the second stop.

Advantageously, it may be provided that the spring element has a pressure stage.

A spring element with a pressure stage can be of a mechanically simple construction. For example, the spring element may be formed in the manner of a helical spring, a force effect on the spring element taking place whenever the first stop and the second stop approach one another and compression of the spring element causing a charging or input of energy into the spring element.

Furthermore, it may advantageously be provided that the abutment has a damping element for the first stop.

An abutment has the effect of limiting a movement of the first stop. The abutment may preferably be provided by the second stop, the use of a damping element at the abutment attenuating hard impact of the introduction of forces or impulses from the first stop into the second stop. The damping element may be formed as an energy dissipating element. For example, the damping element may be formed as a cup spring. Cup springs have a small travel with high spring rates. The abutment makes it possible for a pretensioning to be applied to the spring element. This allows in particular the clearance fit to be secured.

A further object of the invention is to provide an electrical switching device that has a first switching contact piece and a second switching contact piece, the switching contact pieces being movable relatively in relation to one another. The electrical contacting of the switching contact pieces is intended in this case to take place in a mechanically and electrically stable manner. Consequently, an object of the invention is to provide a switching device that can perform reliable switching operations. According to the invention, the object is achieved in the case of an electrical switching device with a first switching contact piece and a second switching contact piece, which are movable relatively in relation to one another, by a kinematic chain that serves for a relative movement of the switching contact pieces in relation to one another having a contact press-on assembly according to one of the foregoing embodiments.

An electrical switching device is a device by means of which a current path can be interrupted or established. For this purpose, switching contact pieces that are movable relatively in relation to one another are used, at least one of the switching contact pieces being coupled to a kinematic chain, in order to be able to bring about a relative movement between the switching contact pieces. The kinematic chain acts as a means for producing a relative movement, while the contact press-on assembly may be designed as part of the kinematic chain. Thus, on the one hand the contact press-on assembly allows a sufficient contact-pressing force of the switching contact pieces in relation to one another to be achieved, on the other hand the contact press-on assembly, with a spring element arranged therein, provides protection from mechanical overloading, for example as a consequence of the switching contact pieces striking flush against one another. The switching contact pieces may for example be arranged with their end faces opposite one another and, for contacting, stop with their end faces flush against one another. The contact press-on assembly in this case secures the flushly abutting switching contact pieces in a switched-on position of the electrical switching device.

Between the switching contact pieces of the electrical switching device there extends a switching gap which, depending on the switching state of the electrical switching device, has a contact resistance tending toward infinity or a contact resistance tending toward zero.

Advantageously, a switching gap may be arranged between the switching contact pieces within a vacuum interrupter.

The use of a vacuum rules out the presence of free charge carriers, which would make it possible for an electrical current to be transmitted over the switching gap in the switched-off state. The interior of the vacuum interrupter is hermetically sealed from the surroundings of the vacuum interrupter. A relative movement of the switching contact pieces in relation to one another is generally transmitted through a wall of the vacuum interrupter.

Hereinafter, an exemplary embodiment of the invention is schematically shown in a drawing and subsequently described in more detail.

DESCRIPTION OF THE INVENTION

Figure 1:
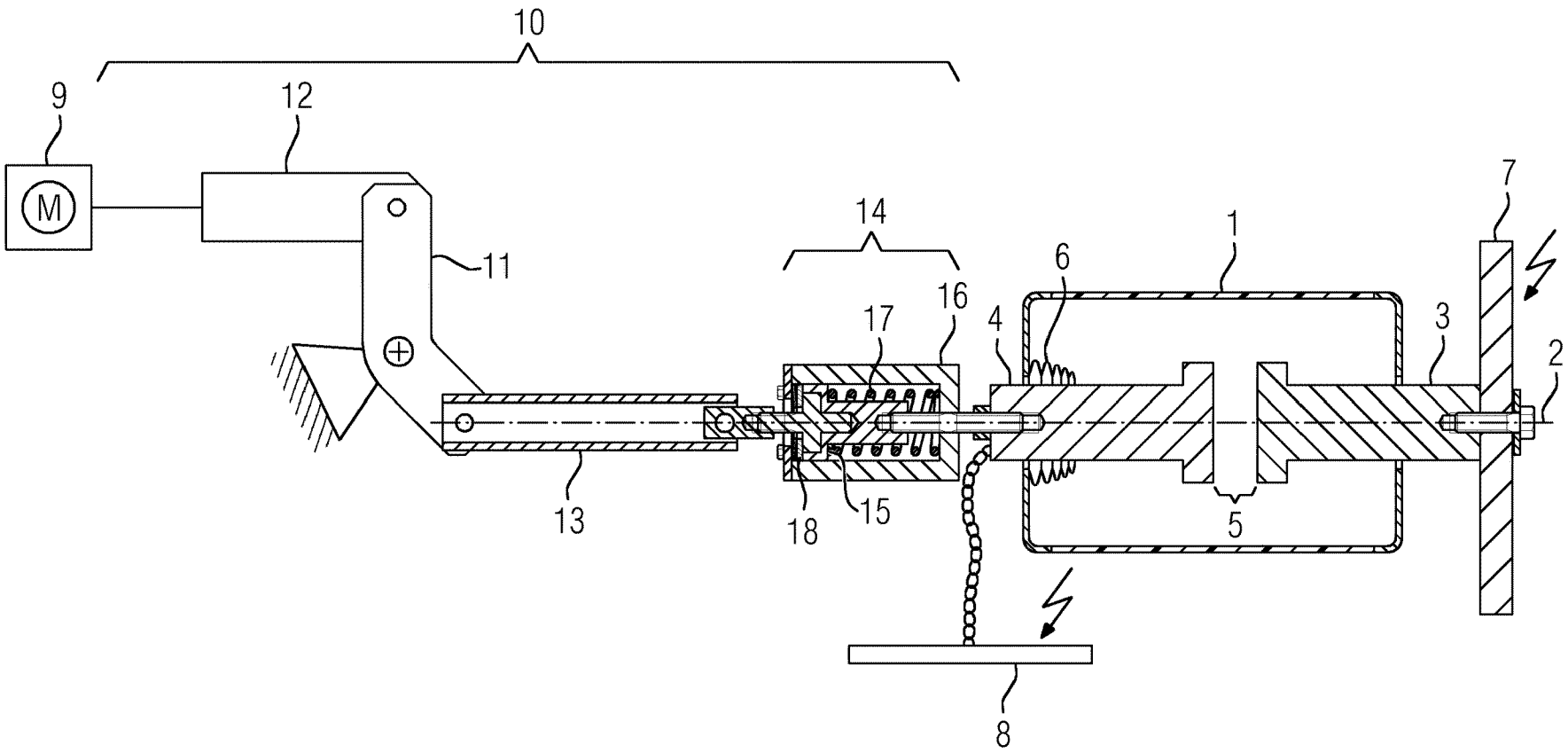
FIG. 1 shows a section through an electrical switching unit in the switched-off state.

FIG. 1 shows an electrical switching unit, which has a vacuum interrupter 1. The vacuum interrupter 1 has an electrically insulating main body. The electrically insulating main body is in the present case of a hollow-cylindrical design and is aligned rotationally symmetrically with respect to a main axis 2. At the end faces, the main body of the vacuum interrupter 1 is closed off in a fluid-tight manner by electrically conducting closure caps, so that a vacuum is hermetically enclosed in the interior of the vacuum interrupter 1. The electrical switching unit also has a first switching contact piece 3 and a second switching contact piece 4. The two switching contact pieces 3, 4 are of the same construction. They respectively have a contact stem and also a contacting region. The switching contact pieces 3, 4 are arranged with their end faces opposite one another and aligned substantially coaxially with respect to the main axis 2, the contacting regions of the switching contact pieces 3, 4 facing one another. The first switching contact piece 3 is aligned fixed in place relative to the vacuum interrupter 1. The second switching contact piece 4 is aligned relatively movably with respect to the first switching contact piece 3. Arranged between the mutually facing ends (contacting regions) of the switching contact pieces 3, 4 is a switching gap 5. The contact stem of the first switching contact piece 3 is inserted at a fixed angle in the associated end-face closure cap of the vacuum interrupter 1. The second switching contact piece 4, or its stem, passes through the other electrically conducting closure cap of the vacuum interrupter 1. In this case, a reversibly deformable vacuum-tight bond between an end-face closure cap and the second switching contact piece 4 is formed by means of a bellows 6. Correspondingly, the second switching contact piece 4 is movable along the main axis 2, it being possible for a movement to be performed relative to the vacuum interrupter 1 and also relative to the first switching contact piece 3. The first switching contact piece 3 is connected at a fixed angle to a phase conductor 7, so that the vacuum interrupter 1 is mechanically supported on the phase conductor 7 by way of the first switching contact piece 3. Furthermore, an electrically conducting connection between the first switching contact piece 3 and the phase conductor 7 is provided by way of the contacting with the phase conductor 7. The second switching contact piece 4 is connected in an electrically conducting manner to a further phase conductor 8 by way of a suitable connection. By way of example, a flexible electrically conducting connection between the second switching contact piece 4 and the further phase conductor 8 is represented in the figure. It may also be provided that further suitable contacting means, such as for example sliding contacts, rubbing contacts or the like, are used in order to perform an electrical connection of the movable second switching contact piece 4 to the further phase conductor 8, and at the same time not appreciably impair the mobility of the second switching contact piece 4. Advantageously, electrical contacting of the second switching contact piece 4 and similarly of the second switching contact piece 3 takes place outside the vacuum interrupter 1. By way of the two switching contact pieces 3, 4, an electrically conducting connection between the phase conductor 7 and the further phase conductor 8 can be established or broken.

In order to be able to bring about a movement of the second switching contact piece 4, a drive device 9 is provided. The drive device 9 can deliver a drive movement, in order to bring about a movement of the second switching contact piece 4. In order to transmit the movement in a suitable form, possibly transform or influence it, a kinematic chain 10 is used. The kinematic chain 10 extends from the drive device 9 to the second switching contact piece 4. For this purpose, the kinematic chain 10 has various transmission elements. On the one hand, a fixedly mounted two-arm deflecting lever 11 is provided, connected to the drive device 10 by a first lever arm by way of a connecting rod 12. The deflecting lever 11 is connected by a second lever arm to a push rod 13. The push rod 13 has an electrically insulating portion, so that an electrical insulation of the deflecting lever 11 and also of the further elements of the kinematic chain 10 that lie in the direction of the drive device 9 with respect to the second switching contact piece 4 is ensured. The push rod 13 has for example a tube which is formed from electrically insulating material, for example glass-fiber reinforced plastic.

The push rod 13 is connected by its end remote from the deflecting lever 11 to a contact press-on assembly 14. The contact press-on assembly 14 serves for the transmission of a linear movement, which can be introduced to the contact press-on assembly 14 from the push rod 13. The contact press-on assembly 14 in turn is connected to the second switching contact piece 4, so that a movement introduced from the push rod 13 can be transmitted to the second switching contact piece 4 by way of the contact press-on assembly 14. The contact press-on assembly 14 has a first stop 15 and also a second stop 16. The first stop 15 is connected to the push rod 13. Arranged between the first stop 15 and the second stop 16 is a spring element 17. The spring element 17 serves for the transmission of a movement that originates from the first stop 15. The first stop 15 is guided by the second stop 16. The first stop 15 is guided in the manner of a piston within a cylinder-like opening of the second stop 16. The spring element 17 is in this case guided under pretension between the two stops 15, 16, the second stop 16 providing an abutment 18 for the first stop 15. A pretensioning of the spring element 17 between the two stops 15, 16 is made possible by the abutment 18. The first stop 15 is movable relative to the second stop 16, such a movement taking place by tensioning or relaxing the spring element 17. A more detailed construction of the contact press-on assembly 14 is shown by way of example in FIG. 3.

In the case of a switching-on operation, a drive force is delivered by the drive device 9 to the kinematic chain 10. The connecting rod 12 activates the deflecting lever 11, whereupon the latter passes on a movement to the push rod 13. A rotationally movable coupling compensates for instances of overtravel caused by the rotational movements of the deflecting lever at the connecting rod 12 or push rod 13. In the case of a switching-on movement, a movement is applied by way of the first stop 15 to the (pretensioned) spring element 17, whereby the latter moves the first stop 16. Connected at a fixed angle to the first stop 16 is the second switching contact piece 4, so that a movement is also transmitted to the second switching contact piece 4. The second switching contact piece 4 approaches with its contacting region the contacting region of the first switching contact piece 3. The switching gap 5 is reduced in its extent along the main axis 2. A movement of the second switching contact piece 4 and similarly of the contact press-on assembly 14 in this case takes place substantially in the direction of the main axis 2. With contacting of the contacting regions of the first switching contact piece 3 and the second switching contact piece 4, a current path between the phase conductor 7 and the further phase conductor 8 is closed. In order to secure the position of the switching contact pieces 3, 4, after the contacting and after an end of the relative movement of the switching contact pieces 3, 4 in relation to one another, an overtravel is brought about by the drive device 9. On account of the fixed stopping of the second switching contact piece 4 against the first switching contact piece 3, the second stop 16 is prevented from further movement. Further driving of the drive device 9 has the effect of driving the first stop 15 further forward. On account of the fixing of the second stop 16, there is a tensioning of the spring element 17. After sufficient tensioning of the spring element 17, the drive device 9 is switched off, whereby the position of the push rod 13 is fixed. The push rod 13 consequently continues to press the first stop 15 against the second stop 16, with the tensioned spring element 17 interposed, and consequently the two switching contact pieces 3, 4 are pressed against one another. In the switched-on state, the contact press-on assembly 14 undertakes the securing of the relative position of the two switching contact pieces 3, 4 in relation to one another.

Figure 2:
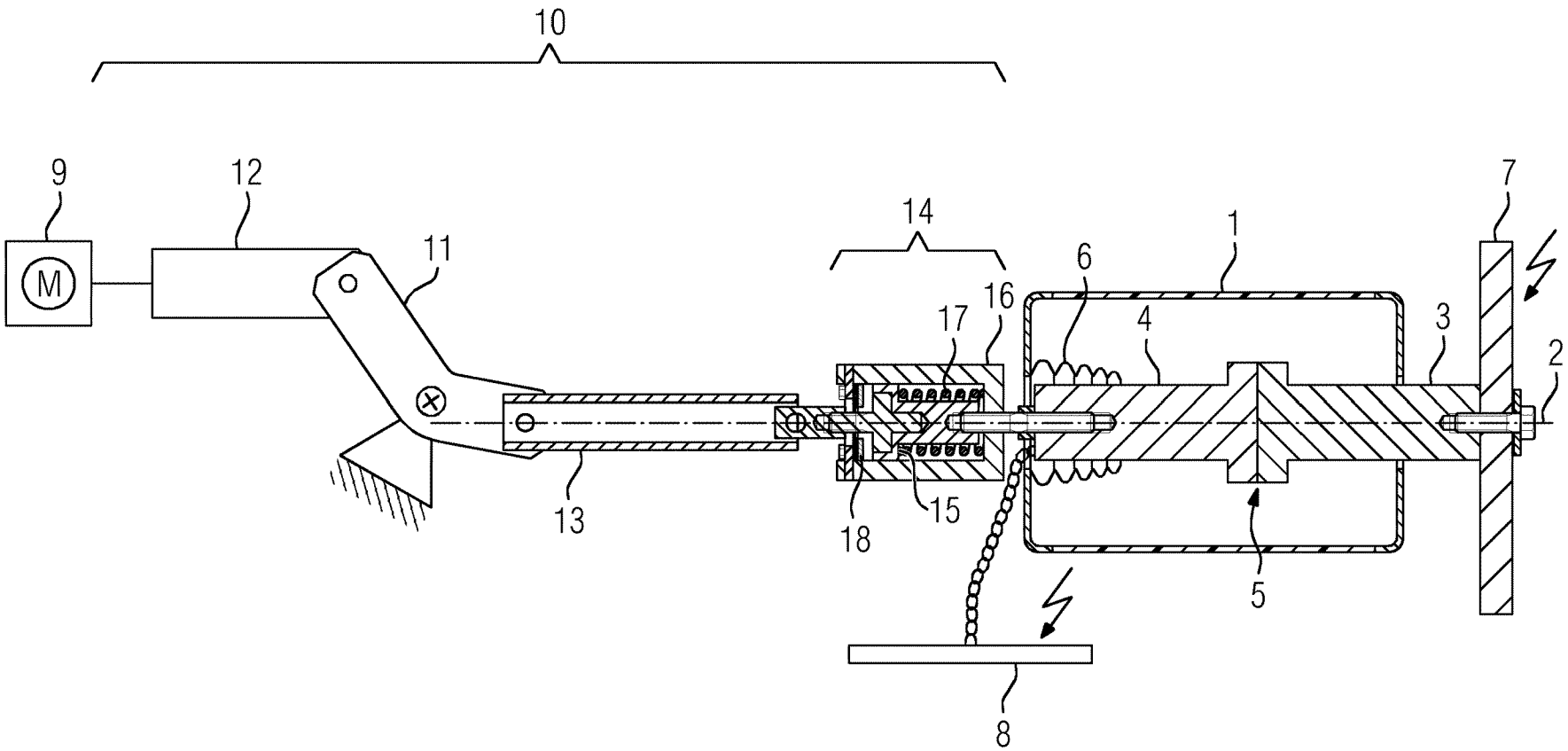
FIG. 2 shows a section through the electrical switching unit in the switched-on state.

The switched-on state of the electrical switching unit is shown in FIG. 2. In comparison with FIG. 1, it can be seen that the first stop 15 has moved away from the abutment 18, while the spring element 17 has undergone a tensioning.

In the case of a switching-off operation (reversal of the movement from FIG. 2 to FIG. 1), the directional sense of the drive movement of the drive device 9 changes, i.e. the push rod 13 is moved with the opposite directional sense along the main axis 2 by way of the connecting rod 12 and the deflecting lever 11. As a result, first the spring element 17 is relaxed, until the first stop 15 comes to lie against the abutment 18 of the second stop 16. The spring element 17 is then under pretension. With the stopping of the first stop 15 against the abutment 18 of the second stop 16, a movement that is initiated by the push rod 13 is also transmitted by way of the contact press-on assembly 14 directly to the second switching contact piece 4. The second switching contact piece 4 moves relative to the first switching contact piece 3, so that an increase in the size of the switching gap 5 takes place.

Figure 3:
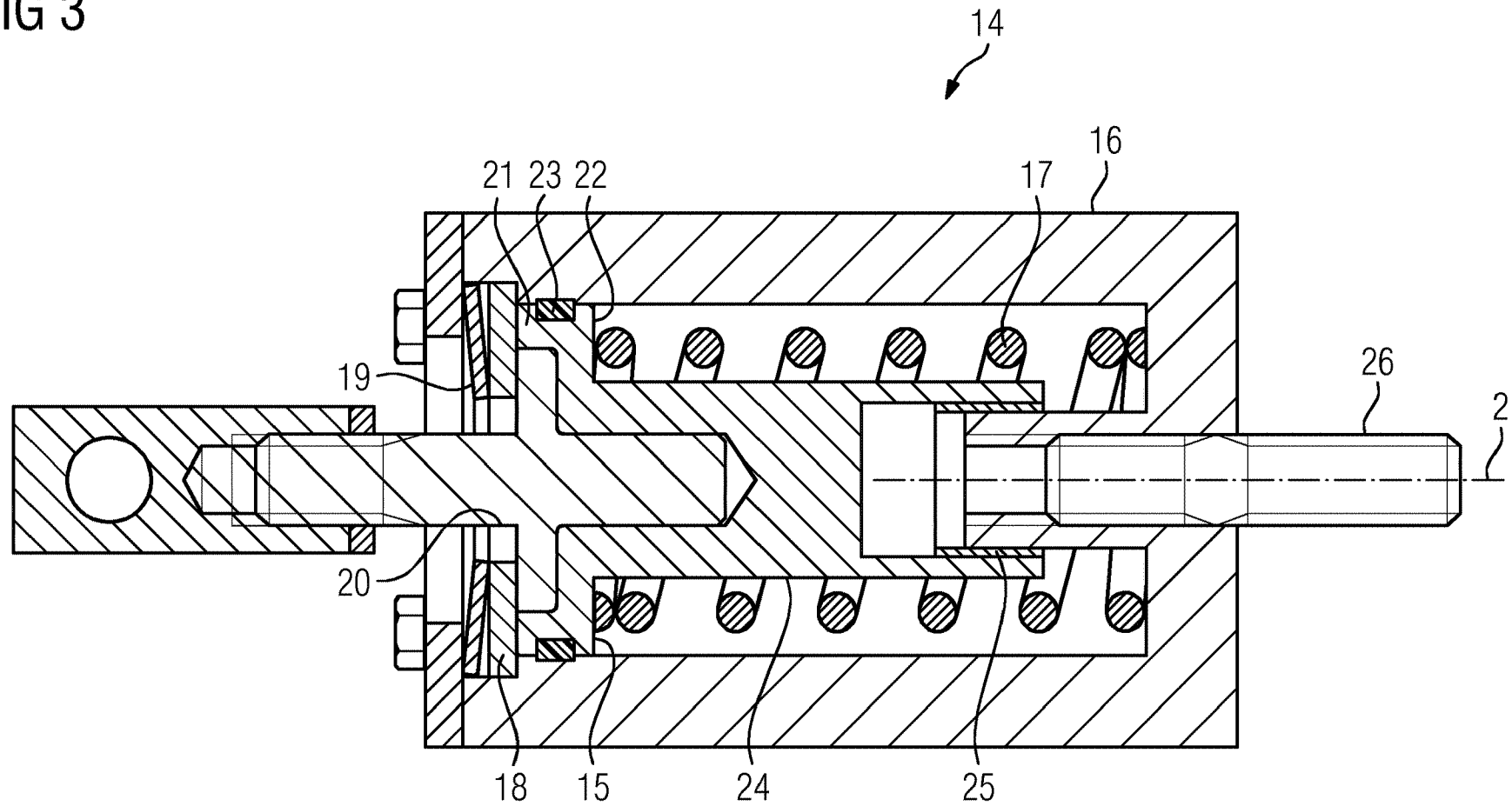
FIG. 3 shows a section through a contact press-on assembly as known from FIGS. 1 and 2 as a detail.

A construction of the contact press-on assembly 14 such as that known from FIGS. 1 and 2 is described on the basis of FIG. 3. The contact press-on assembly 14 has the second stop 16. The second stop 16 is designed in the manner of a cylinder, in which the first stop 16 is guided axially displaceably. A relative movement of the first stop 15 and the second stop 16 in this case takes place substantially along the main axis 2. An abutment 18 for the first stop 15 is formed in the present case in the manner that an annular disk constricts a cylindrical opening of the second stop 16 with a cup spring 19 (damping element) interposed. The elastic design of the abutment 18 has the effect that stopping of the first stop 15 against the abutment 18 is damped. Alternatively, instead of using a cup spring 19, some other dissipating element may also be provided.

In order to be able to couple the first stop 15 to the push rod 13, the first stop 15 is provided with a carrying element 20. On the one hand, the carrying element 20 protrudes into the interior of the second stop, on the other hand, the carrying element 20 protrudes through the cylindrical opening of the second stop 16 out of the second stop 16. By means of a thread or a lug, the push rod 13 can be coupled indirectly or directly to the carrying element 20 by way of a rotary joint. The carrying element 20 is in this case formed substantially as a bolt, the bolt axis extending substantially coaxially with respect to the main axis 2. The carrying element 20 is provided with a collar 21, which extends radially around a lateral surface of the bolt of the carrying element 20. In this case, the position of the collar 21 is chosen in such a way that it is enclosed by the second stop 16. This collar 21 may suitably serve for stopping against the abutment 18, so that, driven by the spring element 17, loosening of the first stop 15 from the second stop 16 is prevented.

The carrying element 20 has on the end face a rotationally movable disk 22. The rotationally movable disk 22 serves for allowing the spring element 17 to lie against the first stop 15. The rotationally movable disk 22 is mounted on the carrying element 20 rotatably relative to the main axis 2. In the present case, the rotationally movable disk 22 is formed in such a way that it covers the end face of the collar 21 that is facing the spring element 17 and also provides coverage of the collar 21 on the lateral surface. Together with the area with which the collar 21 comes to lie against the abutment, an in-line termination of the disk 22 is provided, so that both the collar 21 and the rotationally movable disk 22 come to lie against the abutment 18. On the lateral surface, the rotationally movable disk 22 is supported on the inner wall of a hollow-cylindrical clearance of the second stop 16 and guided in an axially movable manner. In order to perform improved guidance, on the lateral surface a sliding ring 23 is arranged on the circumference of the rotationally movable disk. The rotationally movable disk 22 serves for bearing the spring element 17, which presses the rotationally movable disk 22 against the abutment 18 as a result of a precompression with respect to the second stop 16. A clearance fit is formed between the rotationally movable disk 22 and the carrying element 20, whereby a low-cost rotationally movable guidance of the rotationally movable disk 22 on the carrying element 20 is obtained.

In order to ensure improved radial and axial guidance of the rotationally movable disk 22 on the carrying element 20 of the first stop 15, the rotationally movable disk 22 is centrally provided with a guide pin 24. The guide pin 24 extends centrally within the cylindrical clearance of the second stop 16. In this case, part of the carrying element 20 also extends within the guide pin 24, whereby the guide pin 24 is formed at least in portions both by the rotationally movable disk 22 and by the carrying element 20. Between the outer lateral surface of the guide pin 24 and the inner lateral surface of the cylindrical clearance of the second stop 16, the spring element 17 lies in an annular gap. The spring element 17 is in the present case designed in the form of a helical spring, it being a so-called helical spring with a pressure stage, i.e. a tensioning of the spring element 17 takes place with the turns coming closer together.

At its end remote from the abutment 18 of the first stop 15, the guide pin 24 is provided with an end-face clearance, into which the second stop 16 protrudes with a portion. As a result, the first stop 15 and the second stop 16 are connected to one another in a telescoping manner, one of the stops 15, 16 entering the other when there is a relative movement of the first stop 15 with respect to the second stop 16. To improve the sliding connection between the first stop 15 and the second stop 16, a further sliding bush 25 is incorporated on the inner lateral surface in the clearance of the guide pin 24. Arranged on the second stop 16 coaxially with respect to the alignment of the carrying element 20 of the first stop 15 is a threaded rod 26, by means of which the contact press-on assembly 14 is connected at a fixed angle to the second switching contact piece 4 by way of the second stop 16.

In the case of a switching-on operation before contacting of the two switching contact pieces 3, 4, the precompression of the spring element 17 is chosen in such a way that the spring element 17 presses the first stop 15 against the abutment 18, the second stop 16 forming the basis for the relative movement of the first stop 15 on account of the mounting of the abutment 17. Until there is contacting of the two switching contact pieces 3, 4, the spring element 17 ensures a rigid coupling of the two stops 15, 16. Also in this state, rotational movements in the first stop 15 can be neutralized. With galvanic contacting of the two switching contact pieces 3, 4 and continuing movement within the kinetic chain 10, there is a deformation of the spring element 17 (tensioning of the spring element 17) as a result of a relative movement of the first stop 15 with respect to the second stop 16. The tensioned spring element 17 can then bring about a contact-pressing force between the two switching contact pieces 3, 4. In the case of a switching-off operation, a reversal of the directional sense of the movement of the kinematic chain 10 takes place. At first there is a relaxation of the spring element 17 and a removal of the stops 15, 16 from one another, until the first stop 15 butts against the abutment 18. This butting is damped by the cup spring 19. With the first stop 15 lying against the abutment 18, a movement that is initiated by the drive device 9 is then transmitted by way of the kinematic chain, and is also transmitted to the second switching contact piece 4. The second switching contact piece 4 detaches itself from the first switching contact piece 3 and moves away.

On account of the diverse transmission elements in the path of the kinematic chain and the deflection or transformation of the movement, transverse forces that put a load on the individual bearing points or deflecting points may occur in the kinematic chain 10. The use of a first stop 15 with a rotary bearing allows rotational movements that could continue to the second switching contact piece 4 to be neutralized in the contact press-on assembly. The rotary joint in the first stop serves as a freewheeling mechanism, so that rotational movements are decoupled from the switching contact pieces 3, 4. In addition, the spring element 17 is protected from rotational loads that could change the spring behavior of the spring element 17. When there is a movement of the first stop 15, the rotary bearing that is arranged between the carrying element 20 and the rotationally movable disk 22 on the first stop 15 is moved together with the latter. As a result, loading or securing of the rotary bearing by the spring element 17 is ensured independently of a relative position of the stops 15, 16 in relation to one another and the state of the kinematic chain. Correspondingly, a neutralization of undesired forces in the kinematic chain can be performed by means of a single movable rotary bearing. In this way, on the one hand undesired movement at the switching contact pieces 3, 4 is prevented, on the other hand the contact press-on assembly 14 is kept free of such forces, it being possible for a neutralization of the forces to be brought about in the contact press-on assembly 14 itself can be effected.

The invention claimed is:

1. A contact press-on assembly for a switching contact piece of an electrical switching unit, the contact press-on assembly comprising:

stops including a first stop and a second stop, said first stop being movable relative to said second stop; and a spring element extending between said first stop and said second stop, said second stop forming an abutment for said first stop and at least one of said stops providing a rotary bearing for said spring element, said rotary bearing being movable together with said first stop, said rotary bearing protecting said spring element from transverse forces introduced from outside;

wherein said abutment has a damping element for said first stop.

2. The contact press-on assembly according to claim 1, wherein said first stop is guided by said second stop.

3. The contact press-on assembly according to claim 1, wherein said stops are movable axially in relation to one another.

4. The contact press-on assembly according to claim 1, wherein said first stop has a rotationally movable disk, which is supported on said second stop.

5. The contact press-on assembly according to claim 4, wherein:

said first stop has a carrying element; and said rotationally movable disk is connected to said carrying element of said first stop by way of a clearance fit.

6. The contact press-on assembly according to claim 1, wherein said first stop has a guide pin, which is at least partially enclosed by said spring element.

7. The contact press-on assembly according to claim 6, wherein said guide pin is guided by said second stop.

8. The contact press-on assembly according to claim 1, wherein said first stop and said second stop are guided in a telescoping manner.

9. The contact press-on assembly according to claim 1, wherein said spring element has a pressure stage.

10. An electrical switching device, comprising:

switching contact pieces including a first switching contact piece and a second switching contact piece, which are movable relatively in relation to one another;

a kinematic chain serving for a relative movement of said switching contact pieces in relation to one another, said kinematic chain having a contact press-on assembly, said contact press-on assembly containing:

stops including a first stop and a second stop, said first stop being movable relative to said second stop; and a spring element extending between said first stop and said second stop, said second stop forming an abutment for said first stop and at least one of said stops providing a rotary bearing for said spring element, said rotary bearing being movable together with said first stop, said rotary bearing protecting said spring element from transverse forces introduced from outside;

wherein said abutment has a damping element for said first stop.

11. The electrical switching device according to claim 10, further comprising a vacuum interrupter, said switching contact pieces defining a switching gap therebetween and disposed in said vacuum interrupter.

* * * * *